US005503257A

United States Patent [19]

Sugita et al.

[11] Patent Number: 5,503,257

[45] Date of Patent: Apr. 2, 1996

[54] BRAKE SHOE FOR ELEVATOR SAFETY DEVICE

[75] Inventors: Kazuhiko Sugita; Kazumasa Ito, both of Inazawa, Japan

[73] Assignee: Mitsubishi Denki Kabushiki Kaisha, Tokyo, Japan

[21] Appl. No.: 282,711

[22] Filed: Jul. 29, 1994

[30] Foreign Application Priority Data

Jul. 30, 1993 [JP] Japan ..... 5-189880

[51] Int. Cl.[6] ..... B66B 5/22

[52] U.S. Cl. ..... 188/251 R; 188/250 B; 188/256

[58] Field of Search ..... 188/245, 256, 188/250 G, 250 B, 171, 72.7, 251 R, 73.1; 29/233

[56] References Cited

U.S. PATENT DOCUMENTS 45,975 1/1865 Champlin ..... 188/250 B

FOREIGN PATENT DOCUMENTS 613503 1/1961 Canada ..... 188/251 R
336465 10/1989 European Pat. Off. ..... 188/250 B
22063 2/1979 Japan ..... 188/251 R
56-155178 12/1981 Japan .
59-7682 1/1984 Japan .
59-43781 3/1984 Japan .
1543153 2/1990 U.S.S.R. ..... 188/250 B

*Primary Examiner*—Robert J. Oberleitner
*Assistant Examiner*—Kevin D. Rutherford
*Attorney, Agent, or Firm*—Leydig, Voit & Mayer

[57] ABSTRACT

A brake shoe for an elevator safety device comprising a supporting body provided on a vertically moving body and having a front surface thereof facing a guide rail for being pressed toward the guide rail in the event of an emergency stop; the front surface having a plurality of bottomed holes provided therein; and a plurality of ceramic braking members disposed in the holes of the supporting body and each having a top portion thereof protruding from the front surface of the supporting body and each having an outer size smaller than a complementary size of each the hole. In the brake shoe, deformation, fusion, etc. on braking surfaces and breakage of the braking surfaces due to shocks during operation can be prevented, thereby achieving an improvement in safety and reliability. Further, an elevator speed can be increased and a device size can be reduced. Also, since the braking members have the outer sizes smaller than the complementary size of each of the holes, no compressive stress may normally be generated in the braking members.

10 Claims, 5 Drawing Sheets

BRAKE SHOE FOR ELEVATOR SAFETY DEVICE

BACKGROUND OF THE INVENTION

1. Field of the Invention

This invention relates to a safety device for stopping a vertically moving body in an emergency and, in particular, to a brake shoe for an elevator safety device for stopping an elevator car in an emergency.

2. Description of the Related Art

FIG. 6 schematically shows the construction of a conventional elevator safety device disclosed, for example, in Japanese Patent Laid-Open No. 56-155178, the teachings of which are hereby incorporated by reference. Referring to FIG. 6, a pair of car guide rails 1 are provided on a hoistway wall (not shown). A car 2 is hung to one end of a hoisting rope 3 so as to be hoisted and lowered in the hoistway space along the guide rails 1. A safety device 4 is attached to the bottom of the car 2. The safety device 4 comprises two pairs of brake shoes or braking elements 5 for being brought into contact with and separated from the guide rails 1 and pressure springs 6 for pressing the braking elements 5 against the guide rails 1. The guide rails 1 are respectively held between the braking elements 5 of each pair.

Next, the operation of the above safety device will be described. When the car 2 starts to descend at an undesirable speed which is in excess of the rated speed as a result of accident, breakdown, breakage of the rope 3, etc., the braking elements 5 are pressed against the guide rails 1, and the car 2 is decelerated and brought to a stop by a frictional force generated between the braking surfaces (the sliding surfaces) 5*a* of the braking elements 5 and the guide rails 1. A braking force F obtained by the four braking elements 5 can be expressed by the following formula:

$$F=4\ \mu P,$$

where $\mu$ represents the coefficient of friction and P represents the pressing force of the pressure springs 6.

Thus, a braking performance of the safety device 4 is determined by the product of the coefficient $\mu$ of friction between the braking elements 5 and the guide rails 1 and the pressing force with which the braking elements 5 are pressed against the guide rails 1. Therefore, the safety device 4 could be realized as a small-sized, high-performance device by increasing the coefficient $\mu$ of friction and the pressing force. Before the pressing force P can be increased, the braking elements 5 must be formed of a material having a high withstanding pressure per unit area. As to the coefficient of friction, it can be increased by providing a large number of projections on the braking surface 5*a* of each braking element 5 so as to enable the braking element 5 to be more readily engaged with the guide rails 1. However, this results in a reduction in the effective contact area between the braking surfaces 5*a* and the guide rails 1. Thus, also from this point of view, it is important to select a material having a high withstanding pressure for the braking elements 5.

The withstanding pressure of the braking elements 5 is determined by the frictional fusing limit of the braking surfaces 5*a* when they are pressed against the guide rails 1 and the yield strength of the material of the braking elements 5. When deformation, fusion, etc. are generated on the braking surfaces 5*a* of the braking elements 5, the frictional force becomes unstable and the braking surfaces 5*a* become more liable to be abraded and worn out. In particular, in the case that the car 2 moves at high speed, the abration may become so intense that braking cannot be effected. Thus, to obtain the requisite braking performance, the braking elements 5 should be used within a range where no excessive plastic deformation or fusion is generated on the braking surfaces 5*a*. Regarding the guide rails 1, they are less subject to fusion than the braking surfaces 5*a* since those sections of the guide rails 1 which are in contact with the braking surfaces 5*a* are gradually shifted downwards as the car 2 descends, so that the accumulation of frictional heat is less than on the braking surfaces 5*a*. Therefore, by enhancing the heat resistance of the braking elements 5, deformation, fusion, etc. of the braking surfaces 5*a* can be prevented, thereby making it possible to realize a braking operation with high bearing pressure.

In the conventional safety device for elevators as described above, it is possible to attain an improvement in braking performance by enhancing the heat resistance of the braking elements 5. However, in the case of recently developed super-high-speed, high rise elevators running at a speed of 400 m/min or more, or even at a speed of as high as 1500 m/min, which have already been put into practical use, the braking distance is 10 m or more, so that the frictional heat of the braking surfaces 5*a* during braking exceeds 1000° C., as shown in FIG. 7. In such high rise elevators, a sufficient heat resistance for the braking elements 5 is not to be expected with the conventionally adopted materials, and the requisite level of safety and reliability cannot be obtained.

FIG. 8 shows the relationship between temperature and hardness in various materials. When the temperature of a material rises to such a degree as to cause a marked reduction in hardness, deformation, fusion, etc may occur in the materials except ceramics. As shown in FIG. 8, when compared with the other materials, ceramics are more capable of maintaining a sufficient degree of hardness even at a high temperature and less subject to the occurrence of deformation or fusion. However, ceramics have a rather low level of toughness, so that, if the braking elements 5 are formed of a ceramic material, there is a danger that cracks are generated in the braking elements 5 or the braking surfaces 5*a* are damaged by various shocks during operation and the shock when they hit against the guide rails 1 at the start of theirs operation, resulting in brake failure.

SUMMARY OF THE INVENTION

This invention has been made with a view toward so,lying the above problems in the prior art. It is an object of this invention to provide an elevator safety device which is capable of preventing the generation of plastic deformation or fusion on the braking surfaces of the braking elements even during high-speed operation and which can protect the braking surfaces of the braking elements from breakage and damage due to shocks during operation, thereby, achieving an improvement in terms of safety and reliability, a further increase in elevator speed, and a reduction in the size of the braking elements.

In accordance with this invention, there is provided a brake shoe for an elevator safety device comprising; a supporting body including plurality of recesses provided therein each recess having first and second side walls and a bottom surface. A plurality of ceramic braking members disposed in the recesses of the supporting body, each ceramic braking member having a top portion protruding from the front surface of the supporting body A supporting member is disposed in each of the plurality of recesses at least between the first side walls and the ceramic braking member, wherein said braking member is held closer to said second side wall than said first side wall.

According to another aspect of the present invention, the supporting member holds each of the braking members may be further from the first side wall as viewed in the direction of travel of said shoe and closer to the second side wall such that a distance from the braking member to the first side wall is greater than a distance from the braking member to the second side wall upon emergency stop.

According to a still further aspect of the present invention, the depth of each the hole may be larger than the distance between the top portion of the braking element and the guide rail in the state that the braking element and the guide rail are released from each other.

According to a still further aspect of the present invention, the supporting body may comprise a wedge-shaped supporting body base and a flat braking-member holding plate provided to the supporting body base and having the plurality of holes provided thereon.

According to further aspect of the present invention, the holes may have a tapered cross section such that a diameter of the holes is gradually diminished toward a bottom of the holes, and the braking members may have a tapered cross sectional corresponding to that of the holes.

In this invention, a plurality of the ceramic braking members are provided to the brake shoe, whereby deformation, fusion, etc. of the braking surfaces during high-speed operation can be prevented. Further, each braking surface consists of the above plurality of braking members, whereby breakage and damage of the braking surfaces caused by shocks can be prevented, thereby preventing the braking surfaces from becoming incapable of braking due to such breakage and damage.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
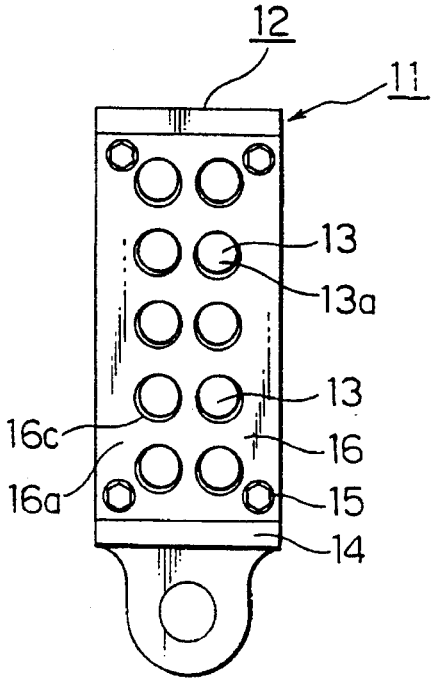
FIG. 1 is a front view showing a brake shoe for an elevator safety device according to a first embodiment of this invention.
Figure 2:
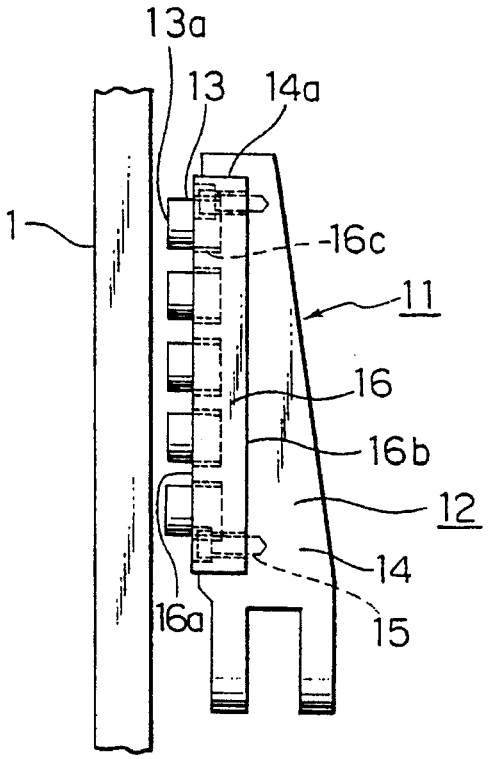
FIG. 2 is a side view of the brake shoe of the safety device of FIG.1.
Figure 6:
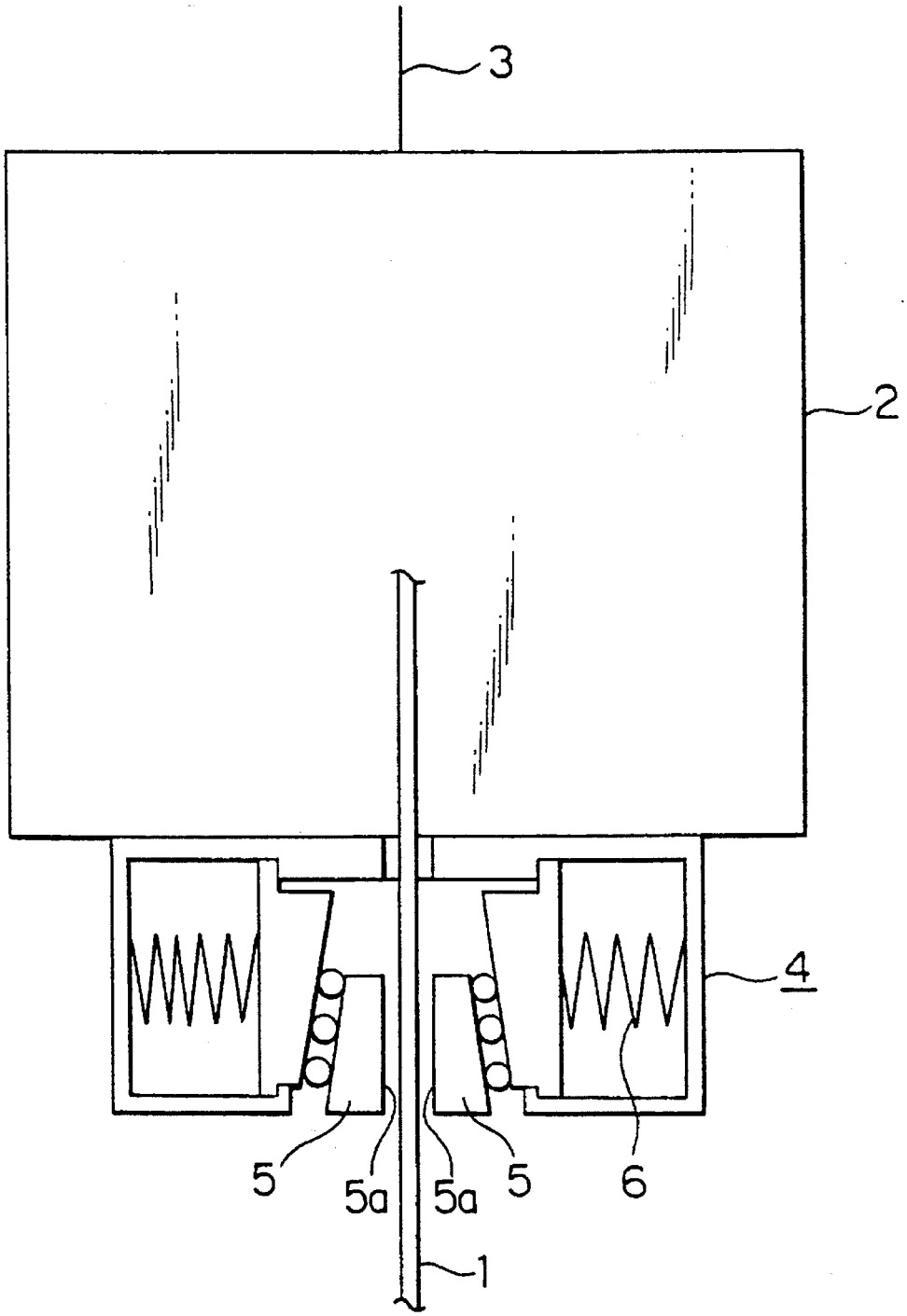
FIG. 6 PRIOR ART
FIG. 6 is a schematic diagram showing a conventional elevator safety device.
Figure 7:
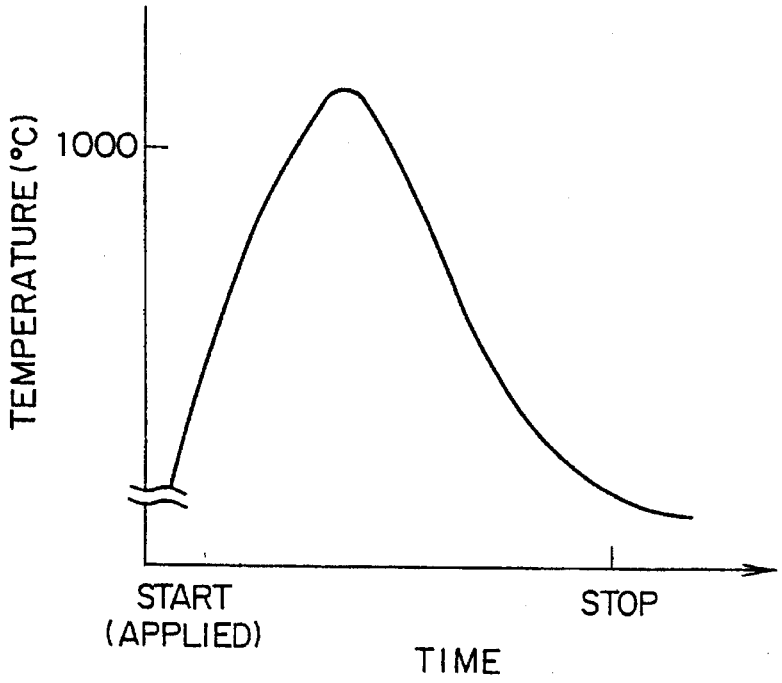
FIG. 7 is a graph showing a variation in temperature on the braking surface of a brake shoe being applied.
Figure 8:
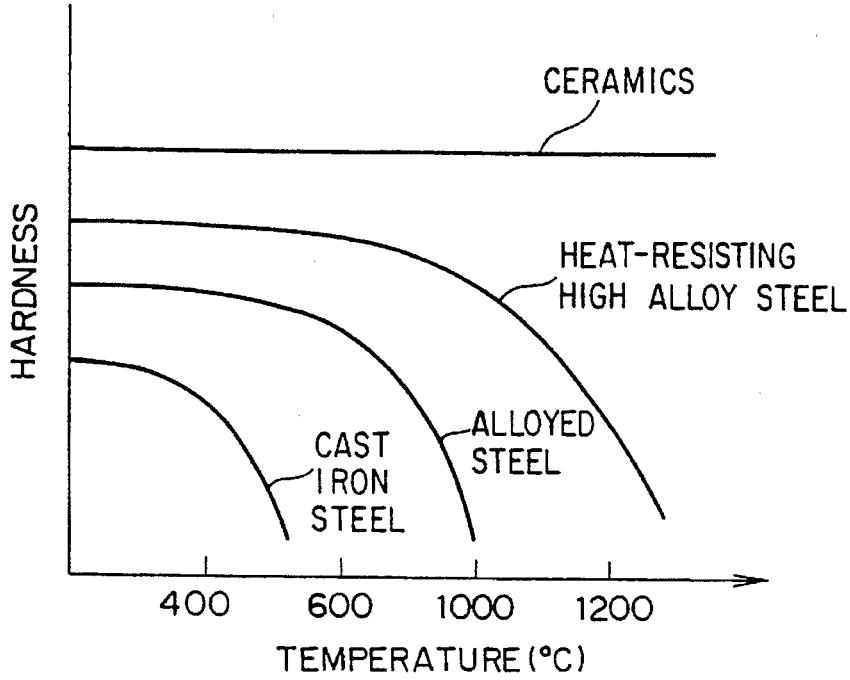
FIG. 8 is a graph showing the relationship between temperature and hardness in various materials.

FIG. 1 is a front view showing a brake shoe 11 or a braking element of an elevator safety device according to a first embodiment of this invention; and FIG. 2 is a side view of the brake shoe 11 of the safety device of FIG. 1. In FIGS. 1 and 2, the brake shoe 11 of the elevator safety device of the present invention comprises a supporting body 12 which may be attached to the car 2 (See FIG. 6), preferably to the bottom of the car 2 similar to the brake shoe 5 of the prior art. The supporting body 12 has a front surface, which, in a preferred embodiment faces a guide rail 1 (See FIG. 6) and which may be pressed toward the guide rail 1 by means, for example, of pressure springs 6 (See FIG. 6) when a car 2 (See FIG. 6) starts to descend at an abnormal speed. The elevator safety device of the present invention also comprises a number of braking members 13 provided to the supporting body 12 and made of a ceramic material (of, for example, alumina type, i silicon nitride type, zirconia type or the like). The supporting body 12 is composed of a wedge type supporting body base 14 and a braking member holding plate 16 made of flat metal plate and secured in a recess **14*a* on the side of supporting body base 14 facing the guide rail 1 by means of a fasteners means such as fastening bolts 15. The supporting body 12 and the braking members compose a braking element 11** of the present invention.

Figure 3:
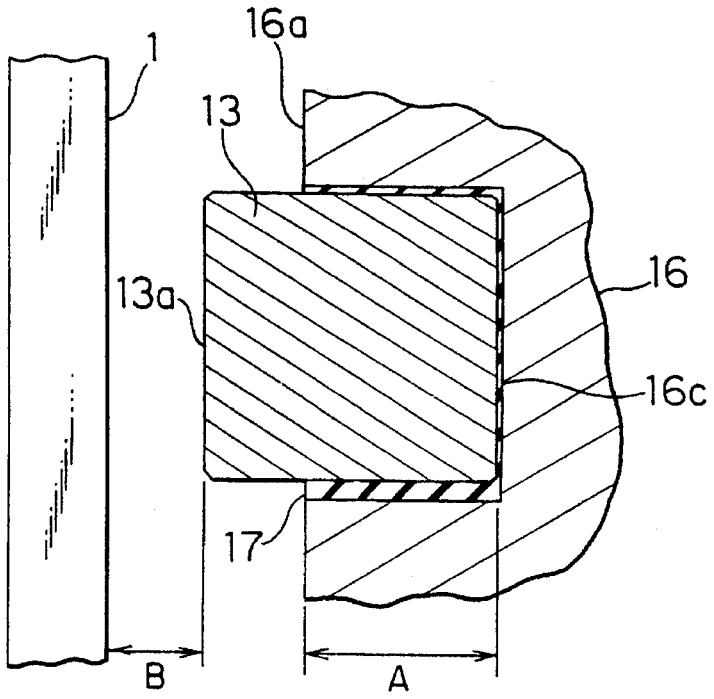
FIG. 3 is an enlarged fragmentary sectional view of the brake shoe of FIG. 2.

As shown in FIGS. 1 and 2, the braking member holding plate 16 is formed as a flat plate having front and rear surfaces **16*a* and 16*b* which are parallel to each other, with the front surface 16*a* facing the guide rail 1. Further, the braking member holding plate 16 has a number of circular holes 16*c* which are formed therein and arranged in two rows and into which the braking members 13 are inserted so as to protrude at the top portion thereof from the front surface 16*a*. The braking members 13 are formed as cylindrical members having a diameter which is smaller than that of the holes 16*c*. FIG. 3 is an enlarged fragmentary sectional view of FIG. 2. As shown in FIG. 3, the depth A of, the holes 16*c* is larger than the distance B between the front surface 13*a* of the braking members 13 and the guide rail 1. Further, each of the braking members 13, inserted into the holes 16*c*, is kept close to the upper side of the associated hole 16*c*, that is, to that portion of the inner wall of the hole which is nearest to the upper floor (i.e., the ascent-side portion) by means of supporting means which, for example are adhesive agent such as epoxy resin filled in gaps between the inner surfaces of the holes 16*c* and the braking members 13 so as to secure the braking members 13 in position. By thus keeping the braking members 13 close to the upper portions of the holes 16*c* and filling the resulting gaps with the adhesive agent 17, it is possible for the force acting on the braking members 13 during operation to be more reliably transmitted to the supporting body 12**, thereby realizing a stable braking effect.

In the safety device having the above-described brake shoe or the braking element 11, the braking members 13 to be pressed against the guide rail 1 in the event of an emergency stop are formed of a ceramic material, so that the braking members 13 provide a high level of heat resistance, thereby preventing deformation or fusion of the braking surfaces **13*a* of the braking members 13. Thus, it is possible to heighten the withstanding pressure of the braking element 11, thereby making it possible for the car 2 to be brought to a stop more reliably and more safely than in the prior art even in the case of a high-speed elevator. Further, due to the provision of the braking members 13 which are made of a ceramic material, it is possible to secure a high level of braking performance even when the salty device is reduced in size. The safety device equipped with this braking element 11** is applicable to elevators of all speed levels. In particular, it proves effective in a super high speed elevator of 400 m/min or more, which requires a high level of heat resistance.

Ceramic materials have a rather low level of toughness, so that they are subject to breakage when applied to braking elements having a large braking area. However, when the braking surface is divided into a number of small braking members 13 as in the first embodiment described above, the individual braking members 13 are less subject to breakage, and, if breakage or cracking should occur in some of the braking members 13, a large number of the other braking members will still remain normal, whereby the danger of the safety device becoming incapable of braking is substantially reduced.

When the braking members are closely fitted into the holes 16*c* by shrinkage fitting, cold fitting or the like, as shown in Japanese Patent Laid-Open No. 59-7682, a constant compressive stress is generated in the braking members 13, thereby making the braking members 13 subject to breakage. In this embodiment, in contrast, the diameter of the braking members 13 are smaller than that of the holes 16*c*, so that usually no stress is generated in the braking members 13, thereby preventing breakage of the braking members 13 during operation. Further, a relatively low machining precision is acceptable in forming the holes 16*c*.

Further, since the braking members 13 inserted into the holes 16*c* are kept close to the upper portions of the holes 16*c*, and the resulting gaps are filled with the adhesive agent 17, the force acting on the braking members 13 during operation can be more reliably transmitted to the supporting body 12, thereby realizing a stable braking operation and preventing breakage of the braking members 13.

Further, since in the normal state the depth A of the holes 16*c* is larger than the distance B between the braking members 13 and the guide rail 1, the braking members. 13 will not slip out of the holes 16*c* even when the adhesive agent 17 is peeled off, thereby ensuring the requisite level of safety and reliability. Furthermore, in this embodiment, the holes 16*c*, which may be provided directly in the wedge type supporting body base 14, are provided in the braking member holding plate 16, thereby facilitating the manufacturing process of the device.

Although in this embodiment the braking members 13 are fixed in the holes 16*c* by means of the supporting means such as the adhesive agent 17, they may also be fastened by some other suitable supporting means. Further, such supporting means may be omitted when the braking members 13 can be secured in the holes 16*c* without using such means.

Figure 4:
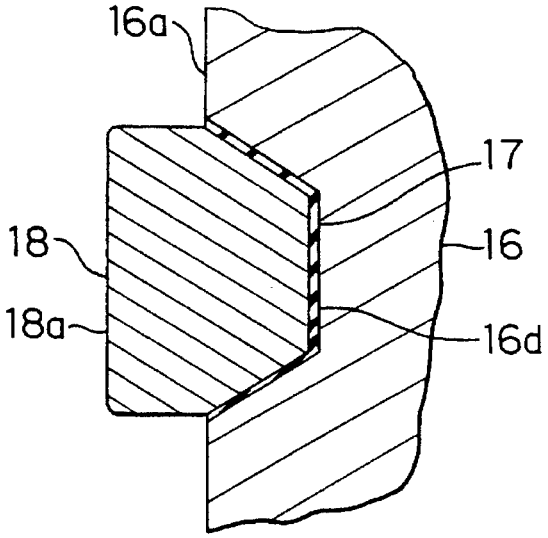
FIG. 4 is an enlarged fragmentary sectional view showing a brake shoe for an elevator safety device according to another embodiment of this invention.

FIG. 4 is an enlarged fragmentary sectional view of another embodiment of the safety device of the present invention, which has basically the same structure as that shown in FIGS. 1–3 but is different in a few points. Such differences in structure include holes 16*d* and braking members 18. As shown in FIG. 4, the front surface 16*a* of the braking member holding plate 16 has a number of holes 16*d* formed thereon and having a tapered sectional configuration such that their diameter is gradually diminished toward the bottom. Braking members 18 which are made of ceramics are inserted into the holes 16*d* and secured therein by means of the supporting means such as the adhesive agent 17. Those sections of the braking members 18 which are inserted into the holes 16*d* have a tapered sectional configuration corresponding to a substantially complementary one of the holes 16*d*. Gaps are defined between the bottoms of the holes 16*d* and the braking members, 18, and these gaps are filled with the adhesive agent 17.

In the safety device as described above, the braking members 18 are made of a ceramic material, as in the above embodiment, so that a high level of heat resistance is obtained, whereby deformation, fusion, etc. of the braking surfaces 18*a* can be prevented, and the car 2 can be stopped more safely and reliably than in the prior art even in the case of a high-speed elevator. Further, due to the provision of a large number of small braking members 18, the individual braking members 18 are less subject to breakage, and no breakage or cracking occurs in all the braking members 18 at the same time, thereby substantially reducing the danger of the device becoming incapable of braking. Moreover, since no compressive stress is normally generated in the braking members 18, breakage of the braking members 18 can be prevented more reliably. In addition, since the holes 16*d* are provided in the flat braking member holding plate 16, the manufacturing process of the safety device is facilitated.

Figure 5:
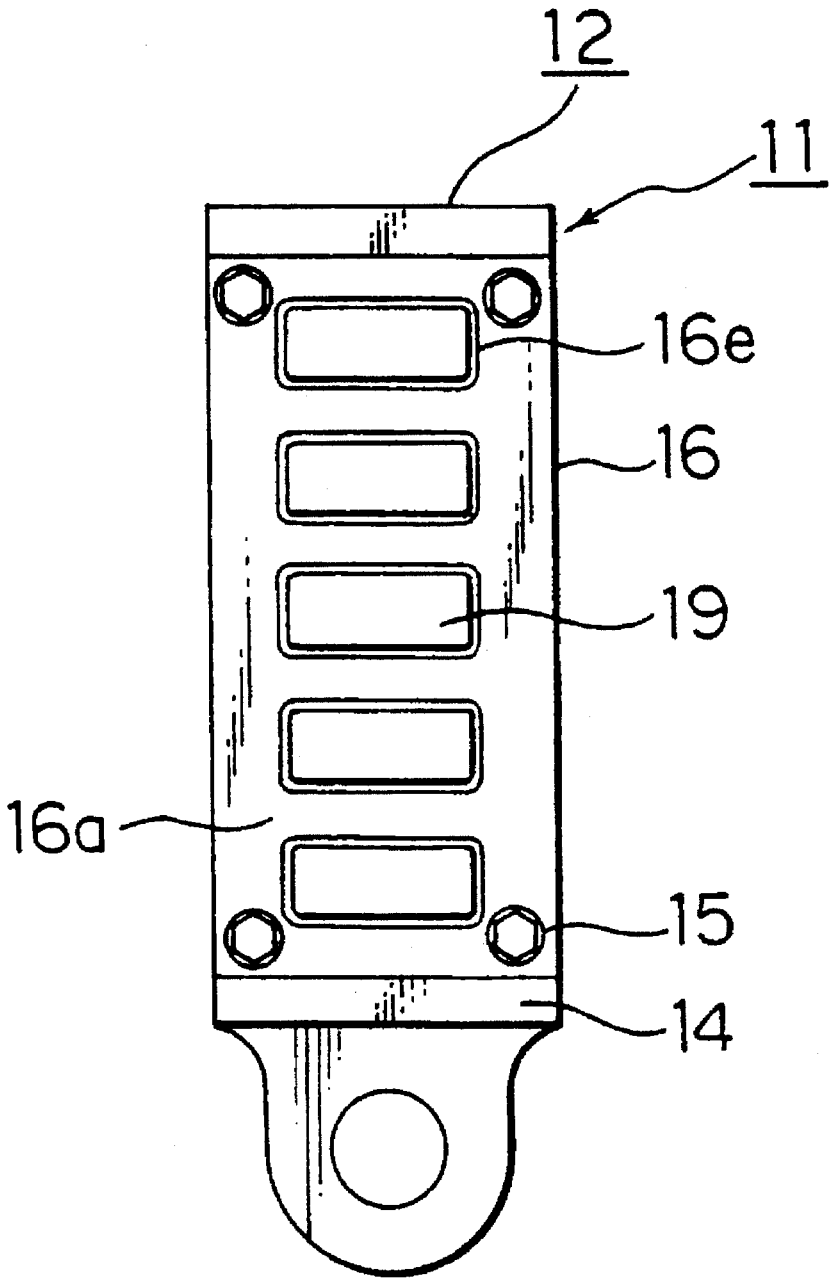
FIG. 5 is a front view showing an elevator safety device according to still another embodiment of this invention.

FIG. 5 illustrates still another embodiment of the safety device of the present invention. This embodiment also has basically the same structure as that shown in FIGS. 1–3. In this embodiment, rectangular holes 16*e* are provided, and correspondingly rectangular braking members 19 are inserted into them. The number of braking members 19 and their layout are not restricted to those of the above embodiments. Thus, it is also possible for the braking members to be arranged in a row, as shown in FIG. 5. In this embodiment, the braking members 19 may be kept close to the upper side of the holes 16*e*, similarly to the embodiment shown in FIGS.1–3.

As has been described above, in the above embodiments, the car 2 is as the vertically moving body to which the safety device is provided, it is also possible for the safety device to be attached to a counterweight (not shown).

Furthermore, while the above embodiments have been described as applied to a safety device for a traction-type. elevator, this should not be construed restrictively. This invention is also applicable to any gradual-braking type safety device for hydraulic elevators, linear motor elevators, etc.

As described above, in an elevator safety device according to the present invention, the supporting body, which is pressed toward the guide rail in the event of an emergency stop, has a plurality of holes on the side which faces the guide rail, and ceramic braking members are inserted into these holes and secured therein, whereby it is possible to prevent breakage or fusion from occurring on the braking surfaces during high-speed operation, and the braking surfaces are protected against breakage due to shocks during operation. Further, the diameter of the braking members is smaller than that of the holes, so that no compressive stress is normally generated, whereby the braking surfaces are more reliably protected from breakage due to shocks and, at the same time, the manufacturing process of the holes is facilitated. As a result, an improvement is attained in terms of safety and reliability, and it is possible to achieve a further increase in the speed of the elevator and a reduction in the device size while remaining safety and reliability enough.

Further, since the braking members inserted into the holes of the supporting body are kept close to the upper portions, i.e., the ascent side portions, of the holes, it is possible to obtain, in addition to the previously described advantages the effect of enabling the force acting on the braking members during operation to be more reliably transmitted to the supporting body, thereby realizing a stable braking operation.

Further, the braking members inserted into the holes of the supporting body, which are kept close to the upper portions, i.e., the ascent side portions, of the holes, are secured in position by providing supporting means between the holes and the braking members, so that it is possible to obtain, more reliable prevention of breakage of the braking members, and, at the same time, the braking operation can be further stabilized.

Furthermore, since the depth of the holes is larger than the distance between the braking members and the guide rails in the released state, the braking members are prevented from slipping out of the holes, whereby a further improvement can be achieved in terms of safety and reliability.

When a plurality of holes having a tapered sectional configuration such that their diameter diminishes toward the bottom, are provided on the side of the supporting body facing the guide rail, and ceramic braking members having a correspondingly tapered sectional configuration are inserted into these holes, positioning of the braking members is facilitated. Further, due to the tapered configuration, the pressing force is distributed, whereby the withstanding pressure of the braking member. holding plate can be enhanced, thereby making it possible to attain a reduction in the size of the braking member holding plate, which leads to a further reduction in the size of the entire braking element.

Further, the manufacturing process of the brake element is facilitated due to the use of a supporting body having a braking member holding plate which has a front surface having a plurality of holes that face the guide rail and a rear surface which is parallel to the front surface.

What is claimed is:

1. A brake shoe comprising:

a supporting body having a front surface including a plurality of recesses provided therein each recess having first and second side walls and a bottom surface;

a plurality of ceramic braking members disposed in the recesses of said supporting body, each ceramic braking member having a top portion protruding from said front surface of said supporting body;

a supporting member disposed in each of the plurality of recesses at least between the first side wall and the ceramic braking member wherein said braking member is held closer to said second side wall than said first side wall.

2. A brake shoe as claimed in claim 1 wherein the supporting member holds each of said braking members further from said first side wall and closer said second side wall such that a distance from the braking member to the first side wall is greater than a distance from the braking member to the second side wall as viewed in the direction of travel of said shoe upon emergency stop.

3. A brake shoe as claimed in claim 2 wherein the supporting member includes an adhesive agent.

4. A brake shoe as claimed in claim 2 wherein the supporting member includes epoxy resin.

5. A brake shoe as claimed in claim 1 in combination with a guide rail wherein the depth of each of said recesses is larger than the distance between the top portion of said braking elements and said guide rail.

6. A brake shoe as claimed in claim 1 wherein said supporting body comprises:

a wedge-shaped supporting body base; and a flat braking-member holding plate provided to said supporting body base and having said plurality of recesses provided thereon.

7. A brake shoe as claimed in claim 1 wherein said recesses have a tapered cross section such that a diameter of said recesses is gradually diminished toward the bottom surface of said recesses and said braking members have a tapered cross section corresponding to that of said recesses.

8. A brake shoe as claimed in claim 7 wherein said supporting body comprises:

a wedge-shaped supporting body base; and a flat braking-member holding plate provided to said supporting body base and having said plurality of recesses provided thereon.

9. A brake shoe comprising:

a supporting body having a front surface including a plurality of recesses provided therein, the recesses having tapered cross sections such that a diameter of the recesses is gradually diminished toward a bottom surface of the recesses; and a plurality of ceramic braking members, each one of the plurality of braking members being disposed in a corresponding one of the plurality of recesses, each ceramic braking member having a top portion protruding from the front surface of said supporting body and each of the ceramic braking members having a tapered cross section corresponding to the cross section of the plurality of recesses.

10. A brake shoe as claimed in claim 9 in combination with a guide rail, the guide rail and the brake shoe being spaced from each other, wherein the depth of each of said recesses is larger than a distance between the top portion of the ceramic braking elements and said guide rail.

* * * * *